US007403214B2

(12) United States Patent
Fields et al.

(10) Patent No.: US 7,403,214 B2
(45) Date of Patent: Jul. 22, 2008

(54) SYSTEMS AND METHODS FOR ADJUSTING THE DYNAMIC RANGE OF A SCANNING LASER BEAM

(75) Inventors: Thomas A. Fields, Winchester, KY (US); Christopher D. Jones, Georgetown, KY (US); William P. Cook, Lexington, KY (US); Cyrus B. Clarke, Lexington, KY (US); Jonathan C. Frey, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 251 days.

(21) Appl. No.: 11/358,351

(22) Filed: Feb. 21, 2006

(65) Prior Publication Data

US 2007/0195153 A1 Aug. 23, 2007

(51) Int. Cl.
*B41J 2/435* (2006.01)

(52) U.S. Cl. ..... 347/236; 347/246

(58) Field of Classification Search ..... 347/133, 347/236–237, 246–247; 250/216; 372/38.02; 345/39

See application file for complete search history.

(56) References Cited

U.S. PATENT DOCUMENTS 4,144,539 A 3/1979 Davie et al.
4,204,725 A 5/1980 DiStefano et al.
4,257,701 A 3/1981 Hirayama et al.
4,370,053 A 1/1983 Hirayama et al.
4,375,067 A 2/1983 Kitamura
4,428,000 A 1/1984 Kuehnle et al.
4,460,909 A 7/1984 Bassetti et al.
4,476,542 A 10/1984 Crean et al.
4,513,300 A * 4/1985 Tatsuno et al. ..... 347/246
4,804,980 A 2/1989 Snelling
4,804,981 A 2/1989 Prakash et al.
4,847,641 A 7/1989 Tung
4,875,190 A 10/1989 Sakano
4,878,225 A 10/1989 Aiba et al.
4,967,238 A 10/1990 Bares et al.
5,012,293 A 4/1991 Aldrich et al.
5,107,278 A 4/1992 Shimada
5,150,157 A 9/1992 Yamaki
5,170,403 A 12/1992 Mayer
5,239,313 A 8/1993 Marko
5,281,999 A 1/1994 Edmunds
5,361,089 A 11/1994 Bearss et al.
5,361,330 A 11/1994 Fujisaki et al.
5,450,189 A 9/1995 Russell et al.
5,463,410 A * 10/1995 Uchiyama et al. ..... 347/133

(Continued)

FOREIGN PATENT DOCUMENTS

JP 11296034 A * 10/1999

*Primary Examiner*—Hai C Pham
(74) *Attorney, Agent, or Firm*—Stevens & Showalter, LLP

(57) ABSTRACT

The dynamic range of an electrophotographic device may be shifted by calibrating a laser power of a laser source to operate within a first range of power levels during a laser power adjustment operation. At least one laser control parameter is modified after calibrating the laser power so that the laser source is operable within a second range of power levels different from the first range of power levels and a beam emitted by the laser source is controlled within the second range of power levels when the beam is directed towards an image area of a photoconductive surface.

20 Claims, 5 Drawing Sheets

U.S. PATENT DOCUMENTS 5,532,731 A 7/1996 Mihara et al.
5,532,795 A 7/1996 Tatsumi et al.
5,557,445 A 9/1996 Misaizu
5,724,088 A 3/1998 Genovese
5,802,089 A 9/1998 Link
5,912,694 A 6/1999 Miyake et al.
5,999,550 A 12/1999 Bellemore et al.
6,021,144 A 2/2000 Meyer et al.
6,069,645 A 5/2000 Vincent
6,151,345 A * 11/2000 Gray ..... 372/38.02
6,184,914 B1 2/2001 Hoberock et al.
6,191,801 B1 2/2001 Hiraoka et al.
6,198,497 B1 3/2001 Luque
6,212,339 B1 4/2001 Inoue et al.
6,246,705 B1 6/2001 Kasai
6,266,073 B1 7/2001 Yergenson
6,292,497 B1 9/2001 Nakano
6,330,413 B1 12/2001 Yamamoto et al.
6,433,804 B1 8/2002 Maess et al.
6,466,595 B2 10/2002 Asano
6,476,370 B1 11/2002 Suzuki et al.
6,504,857 B1 1/2003 Iwazaki
6,566,641 B1 5/2003 Suda
6,570,599 B2 5/2003 Jacob et al.
6,643,301 B2 11/2003 Schrodinger et al.
6,658,225 B2 12/2003 Thompson et al.
6,668,152 B1 12/2003 Jacob
6,696,681 B2 * 2/2004 Kodama ..... 250/216
6,697,400 B2 2/2004 Nomura
6,711,189 B1 3/2004 Gilliland et al.
6,724,793 B2 4/2004 Nagara
6,771,679 B2 8/2004 Schie
6,801,557 B2 10/2004 Liu
6,826,210 B2 11/2004 Moriarty
6,836,126 B2 12/2004 Lin
6,859,473 B1 2/2005 Tan
6,870,864 B2 3/2005 Baumgartner
6,873,805 B2 3/2005 Stelter et al.
6,891,866 B2 5/2005 Robinson et al.
6,909,731 B2 6/2005 Lu
6,917,639 B2 7/2005 Ishida et al.
6,965,357 B2 * 11/2005 Sakamoto et al. ..... 345/39

* cited by examiner

SYSTEMS AND METHODS FOR ADJUSTING THE DYNAMIC RANGE OF A SCANNING LASER BEAM

BACKGROUND OF THE INVENTION

The present invention relates in general to an electrophotographic imaging device, and more particularly to systems and methods for shifting the dynamic range of laser power of a laser beam, e.g., for discharging a photoconductive surface using a laser beam that is also used for writing image data during imaging operations.

In electrophotography, an imaging system forms a latent image by exposing select portions of an electrostatically charged photoconductive surface to laser light. Essentially, the density of the electrostatic charge on the photoconductive surface is altered in areas exposed to the laser beam relative to those areas unexposed to the laser beam. The latent electrostatic image thus created is developed into a visible image by exposing the photoconductive surface to toner, which contains pigment components and thermoplastic components. When so exposed, the toner is attracted to the photoconductive surface in a manner that corresponds to the electrostatic density altered by the laser beam. The toner pattern is subsequently transferred from the photoconductive surface to the surface of a print substrate, such as paper, which has been given an electrostatic charge opposite that of the toner.

A fuser assembly then applies heat and pressure to the toned substrate before the substrate is discharged from the apparatus. The applied heat causes constituents including the thermoplastic components of the toner to flow into the interstices between the fibers of the medium and the applied pressure promotes settling of the toner constituents in these voids. The toner solidifies as it cools adhering the image to the substrate.

During operation of the electrophotographic device, if a charge roll of the imaging system is turned off and the associated photoconductive surface carries an excessive electrostatic charge, there is the potential for print artifacts such as ghost images, color shifts and other residual image artifacts on the first page of the first print job after restarting the device. However, print artifacts that may occur as a result of transiently turning on and off the imaging system can be mitigated by discharging the photoconductive surface to a generally consistent, intermediate level by implementing a run out process as part of a power down sequence of operations.

In conventional printing systems, discharge operations are performed using an erase assembly. The erase assembly typically includes a light source, such as a fluorescent tube or Light Emitting Diode (LED) array, which is positioned at each transfer station so as to face the image area of a corresponding photoconductive surface. Alternatively, light emitted by the light source may penetrate a semi-transparent layer, e.g., by positioning the erase assembly on a side of an intermediate transfer belt (ITM belt) opposite from the photoconductive surface, e.g., a photoconductive drum (PC drum). In this configuration, light from the light source shines through the ITM belt and partially discharges the PC drum during the run out process. Regardless of which conventional architecture is used, the erase assembly requires a light source positioned about the photoconductive surface, which affects the size of the imaging system.

SUMMARY OF THE INVENTION

A method of adjusting the dynamic range an electrophotographic device comprises calibrating a laser power of a laser source to operate within a first range of power levels during a laser power adjustment cycle of operation. At least one laser control parameter is modified after calibrating the laser power so that the laser source is operable within a second range of power levels, which is different from the first range of power levels and a beam emitted by the laser source is controlled within the second range of power levels when the beam is directed towards an image area of a photoconductive surface.

According to another aspect of the present invention, a method of adjusting a dynamic range of an imaging system for an electrophotographic device comprises sweeping a beam emitted by a laser source along a scan line, the scan line having a non-imaging section wherein the beam is outside of an image area of a photoconductive surface and a imaging section wherein the beam is within the image area of the photoconductive surface. While the beam is within the non-imaging section of the scan line, a bias current supplied to the laser source is set to a first bias current level and a laser drive current is calibrated to a level necessary to cause the beam to be emitted by the laser source at a first output power level. The bias current supplied to the laser source is then set to a second bias current level that is different from the first bias current level to cause the output power of the laser source to shift from the first output power level to a second output power level and the beam emitted by the laser source is controlled at the second output power level when the beam is directed towards the image area of a photoconductive surface.

According to yet another aspect of the present invention, an imaging system for an electrophotographic device comprises a laser source for emitting a laser beam, a scanner for causing the laser beam to sweep along a scan line of a photoconductive surface, a laser driver circuit, a controller and a control signal. The laser driver circuit supplies at least a bias current and a laser drive current to cause the laser source to emit the beam. The controller is communicably coupled to the laser driver by the control signal for controlling an output power of the laser beam and the control signal is set by the controller to affect at least one of the bias current and the laser drive current.

The control signal is set to a first value by the controller during a laser power adjustment cycle of operation such that a laser power of the laser source operates within a first range of power levels. The control signal is set to a second value by the controller after calibrating the laser power for adjusting a dynamic range of the output power so that the laser source is operable within a second range of power levels different from the first range of power levels when the laser source is swept along an image area of the scan line.

BRIEF DESCRIPTION OF THE SEVERAL VIEWS OF THE DRAWINGS

The following detailed description of the preferred embodiments of various embodiments of the present invention can be best understood when read in conjunction with the following drawings, where like structure is indicated with like reference numerals, and in which.

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of various embodiments of the present invention.

An Exemplary Electrophotographic Imaging Apparatus

Figure 1:
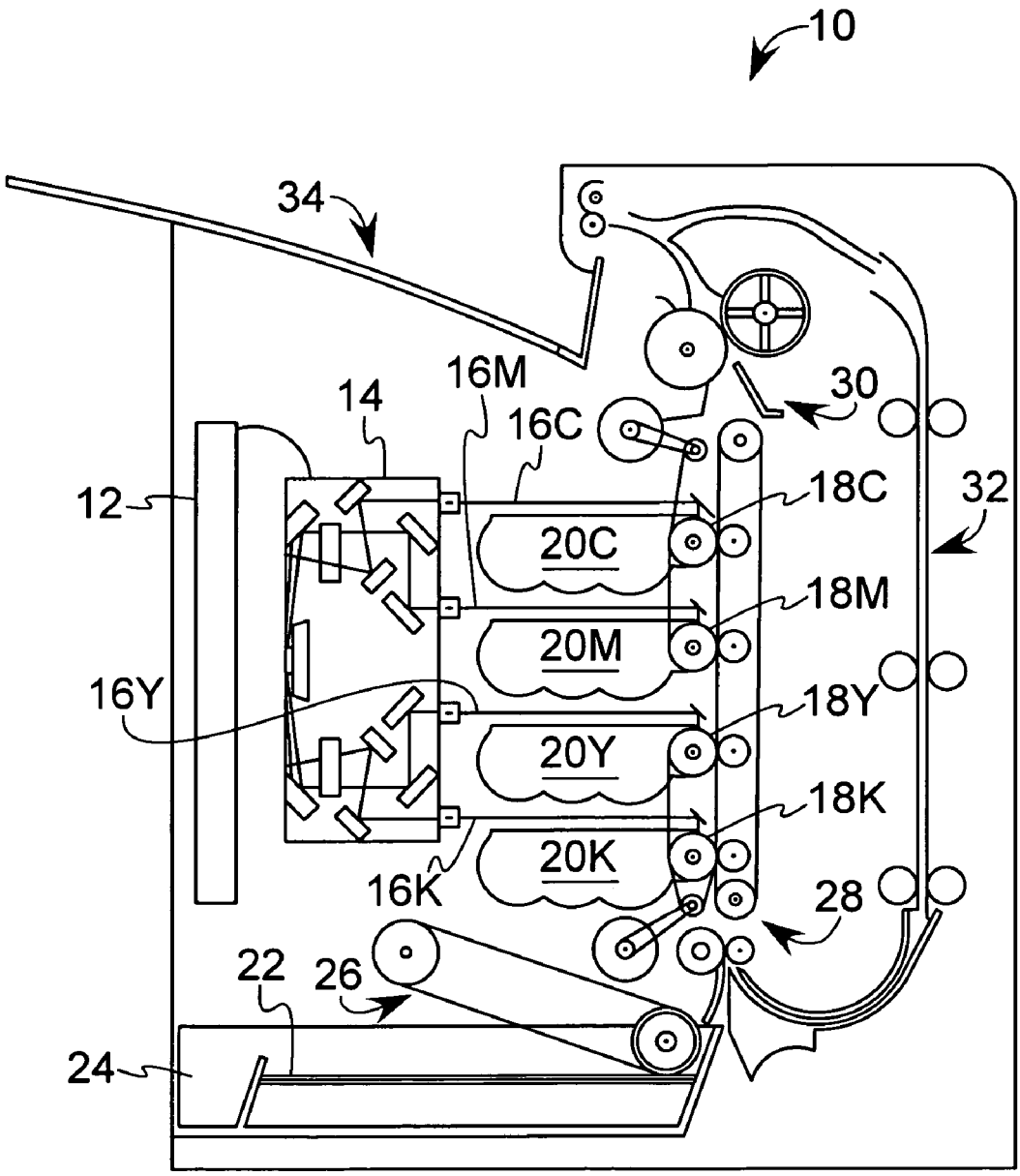
FIG. 1 is a schematic view of an exemplary electrophotographic imaging apparatus implemented as a color laser printer.

Referring now to the drawings, and particularly to FIG. 1, an apparatus, which is indicated generally by the reference numeral 10, is illustrated for purposes of discussion herein as a color laser printer. An image to be printed is electronically transmitted to a main system controller 12 by an external device (not shown). The main system controller 12 includes system memory, one or more processors, and other software and/or hardware logic necessary to control the functions of electrophotographic imaging including the implementation of various aspects of photoconductor discharging as set out in greater detail herein.

For color operation, the image to be printed is de-constructed into four bitmap images, each corresponding to an associated one of the cyan, yellow, magenta and black (CYMK) image planes, e.g., by the main system controller 12 or by the external device. The main system controller 12 then initiates an imaging operation whereby a printhead 14 outputs first, second, third and fourth modulated light beams 16K, 16Y, 16M and 16C respectively.

The first modulated light beam 16K forms a latent image on a photoconductive drum 18K of a first image forming station 20K based upon the bitmap image data corresponding to the black image plane. The second modulated light beam 16Y forms a latent image on a photoconductive drum 18Y of a second image forming station 20Y based upon the bitmap image data corresponding to the yellow image plane. The third modulated light beam 16M forms a latent image on a photoconductive drum 18M of a third image forming station 20M based upon the bitmap image data corresponding to the magenta image plane. Similarly, the fourth modulated light beam 16C forms a latent image on a photoconductive drum 18C of a fourth image forming station 20C based upon the bitmap image data corresponding to the cyan image plane. During the imaging operation, each modulated light beam 16K, 16Y, 16M, 16C sweeps across its corresponding photoconductive drum 18K, 18Y, 18M and 18C in a scan direction that is perpendicular to the plane of FIG. 1.

The main system controller 12 also coordinates the timing of a printing operation to correspond with the imaging operation, whereby a top sheet 22 of a stack of media is picked up from a media tray 24 by a pick mechanism 26 and is delivered to a media transport belt 28. The media transport belt 28 carries the sheet 22 past each of the four image forming stations 20K, 20Y, 20M and 20C, which apply toner to the sheet 22 in patterns corresponding to the latent images written to their associated photoconductive drums 18K, 18Y, 18M and 18C. The media transport belt 28 then carries the sheet 22 with the toned mono or composite color image registered thereon to a fuser assembly 30. The fuser assembly 30 includes a nip that applies heat and pressure to adhere the toned image to the sheet 22. Upon exiting the fuser assembly 30, the sheet 22 is either fed into a duplexing path 32 for printing on a second surface thereof, or the sheet 22 is ejected from the apparatus 10 to an output tray 34.

The above-described apparatus 10 is merely illustrative and other device configurations may alternatively be implemented. For example, the photoconductive drums 18K, 18Y, 18M and 18C may be replaced with a photoconductive belt or other photoconductive surface(s). Moreover, the photoconductive surface(s) may transfer the toned image to an intermediate device such as an electrically conductive intermediate transport belt that subsequently carries the toned image to the sheet 22. As another example, a single photoconductive surface may be used to image each color plane in sequential processing steps. Also, while a single printhead 14 is illustrated, a separate printhead may alternatively be provided for each image forming station 20K, 20Y, 20M and 20C.

An Exemplary Printhead

Figure 2:
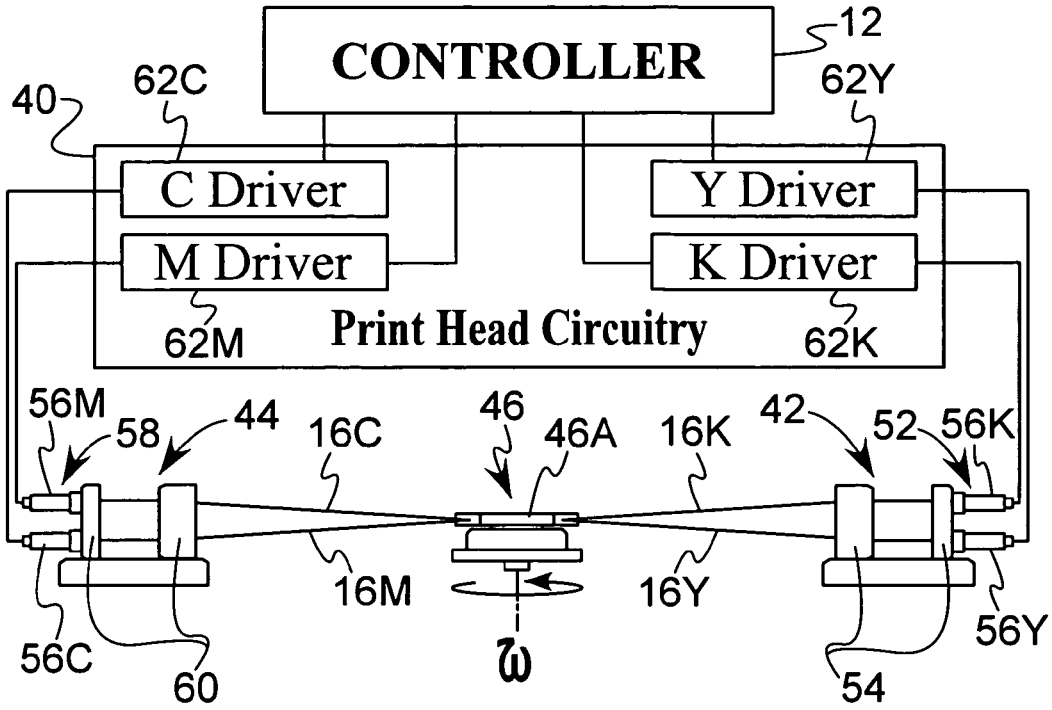
FIG. 2 is a schematic representation of the laser sources and polygon mirror of FIG. 2, illustrating exemplary pre-scan optics and corresponding pre-scan beam paths.

Referring to FIG. 2, the printhead 14 includes generally, printhead circuitry 40 that is communicably coupled to the controller 12 for exchange of CYMK image, control and other data. The printhead 14 further includes first and second pre-scan assemblies 42, 44 and a rotating polygon mirror 46, which is also referred to herein as a scanner.

The first pre-scan assembly 42 comprises a first light assembly 52 and a first pre-scan optical system 54. As illustrated, the first light assembly 52 comprises a first pair of laser sources including a first laser source 56K that is associated with the black image plane and a second laser source 56Y that is associated with the yellow image plane. Similarly, the second pre-scan assembly 44 comprises a second light assembly 58 and a second pre-scan optical system 60. The second light assembly 58 comprises a second pair of laser sources including a third laser source 56M that is associated with the magenta image plane and a fourth laser source 56C that is associated with the cyan image plane. The first, second, third and fourth laser sources 56K, 56Y, 56M, 56C may each be implemented, for example, using a laser diode or other suitable light source.

The first and second pre-scan optical systems 54, 60 each comprise one or more collimating lenses, pre-scan lenses and/or other optical system components as the specific implementation requires to direct and focus each of the modulated beams 16K, 16Y, 16M and 16C emitted by their associated first, second, third and fourth laser sources 56K, 56Y, 56M, 56C towards the polygon mirror 46.

The polygon mirror 46 includes a plurality of facets 46A, e.g., 8 facets, and is controlled to rotate at a fixed rotational velocity ($\omega$) during imaging operations. During operation, the first pair of beams 16K, 16Y each strike a first one of the facets of the polygon mirror and the second pair of beams 16M, 16C each strike a second one of the facets that is different from the first one of the facets. A scan line is formed each time a new facet intercepts its pair of beams. Post scan optics (not shown in FIG. 2) are used to direct each modulated beam 16K, 16Y, 16M and 16C to their corresponding photoconductive drum 18K, 18Y, 18M and 18C as best seen with regard to printhead 14 in FIG. 1. The post scan optical components may each be provided as part of the printhead 14 or such components may be otherwise mounted within the apparatus 10.

The printhead circuitry 40 comprises a first driver circuit 62K that is coupled to the first laser source 56K, a second driver circuit 62Y that is coupled to the second laser source 56Y, a third driver circuit 62M that is coupled to the third laser source 56M, and a fourth laser driver 62C that is coupled to the fourth laser source 56C. During an imaging operation, each laser source 56K, 56Y, 56M, 56C is driven to emit its modulated beam 16K, 16Y, 16M, 16C by their associated driver circuits 62K, 62Y, 62M, 62C based upon corresponding image and control data from the controller 12.

Although FIGS. 1-2 illustrate an exemplary multi-beam printhead and corresponding apparatus, other printhead configurations may alternatively implemented. For example, an apparatus may implement a different multi-beam printhead and/or optical system structure, or the apparatus may include a plurality of separate printheads, e.g., one printhead associated with each of the cyan, magenta, yellow and black image planes.

The Optical Scanner

The overall print quality of the apparatus 10 is sensitive to the optical output of the laser sources 56K, 56Y, 56M, 56C. However, optical power requirements are known to vary widely, e.g., as much as 100% or more, from laser diode to laser diode. To account for such variations, each of the driver circuits 62K, 62Y, 62M, 62C of the printhead circuitry 40 comprise power management circuitry. An exemplary power management circuit is described in detail below.

The Laser Exposure Management System

Figure 3:
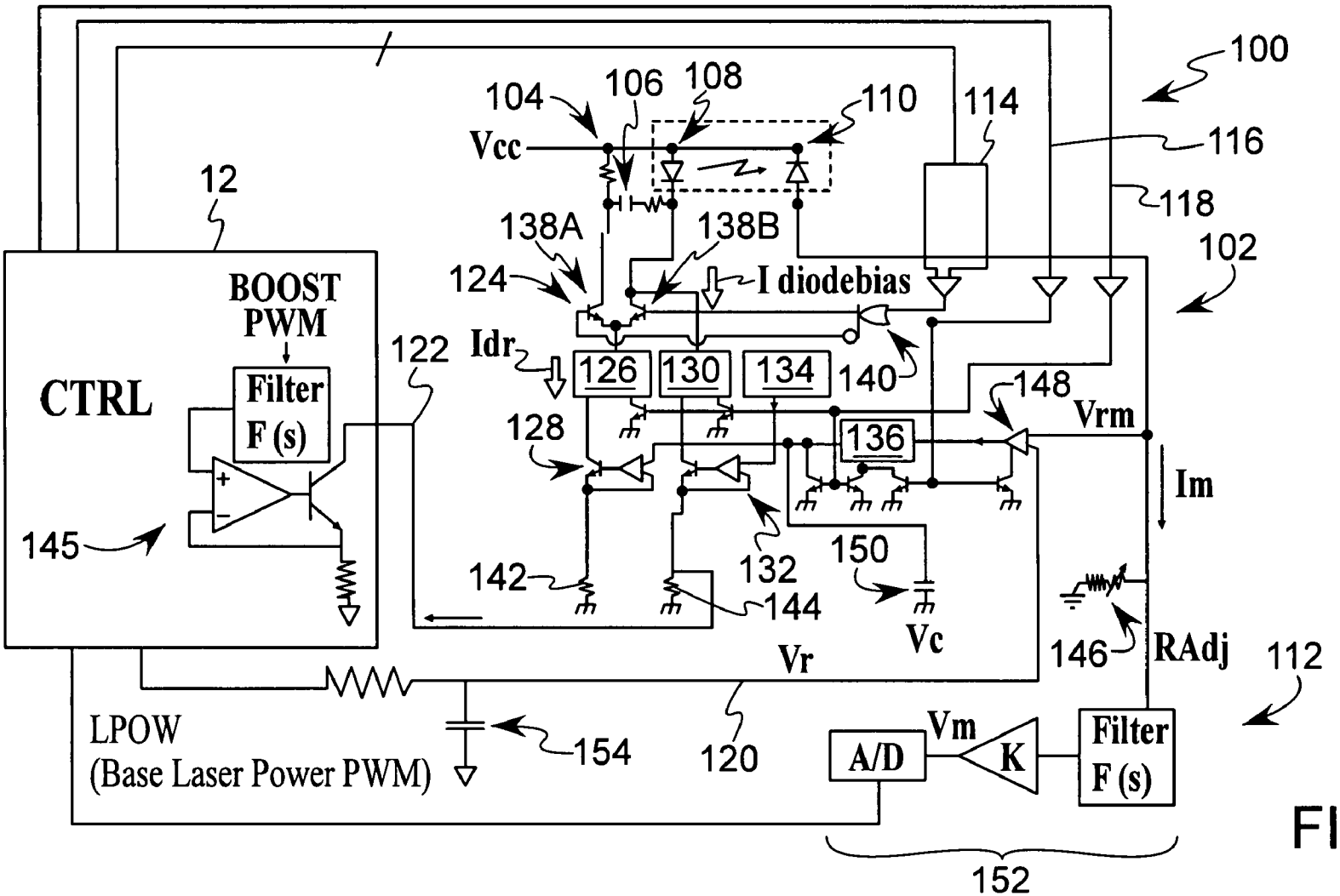
FIG. 3 is a block diagram of an exemplary laser driver circuit.

Each of the driver circuits 62K, 62Y, 62M, 62C of the printhead circuitry 40 may include a laser driver system for performing laser power management functions. With reference to FIG. 3, each laser driver system 100 includes, a laser driver circuit 102, a dummy load 104, a snubber network 106, a laser diode 108, e.g., a corresponding one of the laser sources 56K, 56Y, 56C, 56M, a laser output feedback device 110 optically coupled to the laser diode 108 and a feedback control system 112.

The laser driver circuit 102 is further coupled to the controller 12 via several control and data lines, including a low voltage differential signal (LVDS) image data pair 114, an enable control signal 116, a calibration control signal 118, a laser power control signal 120 and a bias control signal 122. Each of the signals communicated across the various control and data lines 114, 116, 118, 120 and 122 will be explained in greater detail below.

The laser driver circuit 102 comprises a switching output 124, a drive current source 126, drive current circuitry 128, a bias current source 130, bias current circuitry 132, a reference voltage source 134 and a sample and hold circuit 136. The laser driver circuit 102 may be implemented using discrete components and/or using an integrated circuit chip such as the TI SN65ALS544 by Texas Instruments.

As schematically illustrated, the switching output 124 comprises a first transistor 138A and a second transistor 138B. An emitter of each of the first and second transistors 138A, 138B is tied to the drive current source 126. The base of each of the first and second transistors 138A, 138B is tied to the image data pair 114 via a driver 140 such that the base of each transistor 138A, 138B is driven opposite in polarity based upon the value of the image data pair 114.

The collector of the first transistor 138A is tied a supply voltage Vcc through the dummy load 104, which provides a load for the drive current source 126 when the laser diode 108 is not emitting laser light. In practice, the dummy load 104 may be any active or passive device or circuit. As one example, the dummy load 104 is selected to have a nominal resistance value that runs slightly higher than the impedance of the laser diode 108, which lowers the current when the laser diode is switched off. This serves to control the rise of the current through the laser diode 108 thus reducing noise (ringing and overshoot).

The collector of the second transistor 138B is tied to the cathode of the laser diode 108. The anode of the laser diode 108 is tied to the supply voltage Vcc or other suitable voltage source. The snubber network 106 is optional and may be provided to control voltage transients as the laser diode 108 is switched on and off. For example, as illustrated, the exemplary snubber network 106 comprises a series resistor/capacitor circuit tied between the collectors of the first and second transistors 138A, 138B. The cathode of the laser diode 108/collector of the second transistor 138B is further tied to the bias current source 130 as will be explained in greater detail below.

The drive current source 126 provides a drive current Idr, which is switched between the laser diode 108 and the dummy load 104 based upon the value of the image data pair 114. That is, when the image data designates an "ON" state, the first transistor 138A is switched off and the second transistor 138B is switched on. Thus, the drive current Idr provided by the drive current source 126 will pass through the second transistor 138B, thus causing the laser diode 108 to emit laser light. However, because the first transistor 138A is turned off, negligible current will be provided by the drive current source 126 through the first transistor 138A and corresponding dummy load 104.

Similarly, when the image data designates an "OFF" state, the first transistor 138A is switched on and the second transistor 138B is switched off. Accordingly, the drive current Idr provided by the drive current source 126 will pass through the first transistor 138A and the corresponding dummy load 104, but negligible current will be provided by the drive current source 126 through the second transistor 138B. Thus, there will be an insufficient current available to cause the laser diode 108 to emit a beam of laser light. Thus, the drive current Idr is only applied to the laser diode 108 when the laser diode 108 is turned on. In the illustrated example, a laser drive current operating point for the drive current source 126 is established by the drive current source 126 and corresponding drive current circuitry 128, which includes a drive current setting resistor 142. The drive current setting resistor 142 establishes a default range of available laser drive current. The establishment of the laser drive current will be described in greater detail herein.

As noted above, the bias current from the bias current source 130 is not applied to the first transistor 138A. Moreover, the bias current from the bias current source 130 is applied to the cathode of the laser diode 108 independent of the switched state (ON or OFF) of the second transistor 138B. However, the bias current is set to a level that is not sufficient on its own to cause the laser diode 108 to emit a beam of laser light.

The bias current provided by the bias current source 130 is established by the bias current circuitry 132, which includes a bias current setting resistor 144 and the reference voltage source 134, which together establish a first fixed bias current. The amount of bias current generally corresponds to the voltage level of the reference voltage source 134 as a function of the value of the bias current setting resistor 144.

Further, the bias control signal 122 is coupled to the bias current circuitry 132 via a boost current source 145 to provide additional current so that the bias may be shifted from the default bias established by the reference voltage 134 and corresponding bias resistor 144 by a determined amount. Thus, the boost current source 145 couples to the bias circuitry 132 so as to modify the fixed bias current by a programmable amount based upon the duty cycle of the bias control signal 122.

For example, the bias control signal 122 may comprise a programmable boost signal, e.g., as set by the controller 12, that modifies the bias current applied to the laser diode 108. The programmable boost signal may have a first programmable value corresponding to a first bias current level and a second programmable value corresponding to a second bias current level as will be explained in greater detail below. In general terms, the total bias current is the sum of the fixed bias current and the boost current:

$$I\text{diodebias}=I\text{bias}+I\text{boost}$$

Accordingly, when the laser diode 108 is turned on, e.g., by setting the image data pair 114 to an active state while the enable control signal 116 is active, the total laser current comprises the drive current set by the drive current source 126, the bias current set by the bias current source 130 and the boost current source 145 if applied by the controller 12.

$$I_\text{laser_on}=Idr+I\text{bias}+I\text{boost}=Idr+I\text{diodebias}$$

And when the laser diode 108 is turned off, the laser drive current comprises the bias current set by the bias current source 130 and the boost current source 145, if applied by the controller 12.

$$I_\text{laser_off}=I\text{bias}+I\text{boost}=I\text{diodebias}$$

With regard to the discussion above, the various current sources, including the drive current source 126, the bias current source 128 and the boost current source 145 are described as providing current. In this regard, the current may be sourced or sunk, depending upon the application.

The feedback control system 112 comprises the laser output feedback device 110, a calibration resistance 146, comparator 148 and conditioning and feedback circuitry 152. The laser output feedback device 110 may be implemented as a positive-intrinsic-negative (PIN) diode, which produces a current (Im) that corresponds to the output power of the laser diode 108. The PIN diode output current Im is converted into a voltage (Vrm) by calibration resistance 146. In practice, the calibration resistance 146 may be implemented by a single resistor or the series combination of two resistance devices including a fixed resistor and an adjustable resistor, designated Rt and Radj respectively. The adjustable resistor Radj may comprise a manually adjustable potentiometer, digital potentiometer or other device configured such that its resistance can be manually or automatically adjusted.

The controller 12 is configured to initiate a calibration control operation via the calibration control signal 118 when the laser diode 108 is within a non-imaging section of a scan line that is outside the image area of the corresponding photoconductive surface. As an example, during an automatic power calibration (APC) operation, such as when the controller 12 enables the calibration control signal 118, the laser diode 108 is turned on, e.g., by supplying a suitable signal to the image data pair 114. However, because the beam is outside the image area, no print artifacts will be present on the printed output of the apparatus 10.

The comparator 148 compares a first signal corresponding to a measured output power of the laser diode 108, e.g., the voltage Vrm, to an input control signal set to a predetermined laser power control value, e.g., the input control voltage Vr. The input control voltage Vr is coupled to the laser driver circuit 102 from the controller 12 via the laser power control signal 120 and is used to designate a desired power output level of the laser diode 108, which is determined by the controller 12.

The output of the comparator 148 is sampled by the sample and hold circuit 136. The output of the sample and hold circuit 136 is utilized to charge a charge storage device 150, e.g., a capacitor. The laser driver circuit 102 automatically adjusts the drive current of the drive current source 126 until the measured voltage Vrm is approximately the same as the input control voltage Vr. This is accomplished by charging or discharging the charge storage device 150.

The voltage Vc stored by the charge storage device 150 is coupled to the drive current circuitry 128, which sets the drive current Idr in the current source 126 to correspond to the voltage Vc as a function of the value of the drive current setting resistor 142. As the charge across the charge storage device 150 changes, the drive current Idr also changes. As the drive current changes, the output power of the laser diode 108 changes, and that change is measured and fed back to the comparator 148 via the laser output feedback device 110. The above-described loop continues to vary the output power of the laser diode until the measured output power of the laser diode 108 corresponds with the desired laser power set by the controller 12 via the laser power control signal 120.

The voltage Vrm is also periodically sampled by the conditioning and feedback circuitry 152, which may comprise, filters, gain amplifiers analog to digital converters or other hardware to communicate a representation of the voltage Vrm, and thus a measure of the output power of the laser beam emitted by the laser diode 108, back to the controller 12. The controller 12 can thus monitor the output of the laser diode 108. In the illustrated example, the controller 12 is operable to set and/or modify a pulse width modulation (PWM) output signal (Lpow), which is utilized to establish the input control voltage Vr. The PWM output signal is converted to the input control voltage Vr by filter circuitry 154, which comprises a first order low pass filter as schematically illustrated. This closed loop system allows the controller 12 to set an appropriate laser power PWM duty cycle on the laser power signal 120 to achieve a desired spot power output by the laser diode 108 when the laser diode 108 is modulated to an ON state. The controller 12 may use representations other than PWM to adjust the laser power signal 120.

Upon completion of the APC operation, the controller 12 deactivates the calibration control signal 118 and may subsequently set the bias control signal 122 for adjusting the bias current supplied to the laser diode 108 by the laser driver circuit 102 to a second bias current level before the beam emitted by the laser diode 108 enters a imaging section of the scan line, wherein the beam sweeps across the image area of the corresponding photoconductive surface. As will be described in greater detail below, such action may be used to alter the dynamic range of the laser beam, such as for discharge operations to erase the corresponding photoconductive surface or for other purposes where it is desirable to change the operating range of the laser diode 108.

The laser driver circuit 102 may have a limited adjustable input voltage control range. For example, the laser driver circuit 102 may have an adjustable input voltage control range of approximately 0.4V to approximately 2V. Correspondingly, the laser power control signal 120 may be adjusted, for example, between a duty cycle of approximately 20% corresponding to approximately 0.4V and a duty cycle of approximately 100% corresponding to approximately 2V so that the controller 12 may operate the laser diode 108 over the entire range capability of the laser driver circuit 102. Thus, the adjustable input voltage control range of the laser driver circuit 102 may be one limiting factor to the dynamic range of output power from the laser diode 108.

Figure 4:
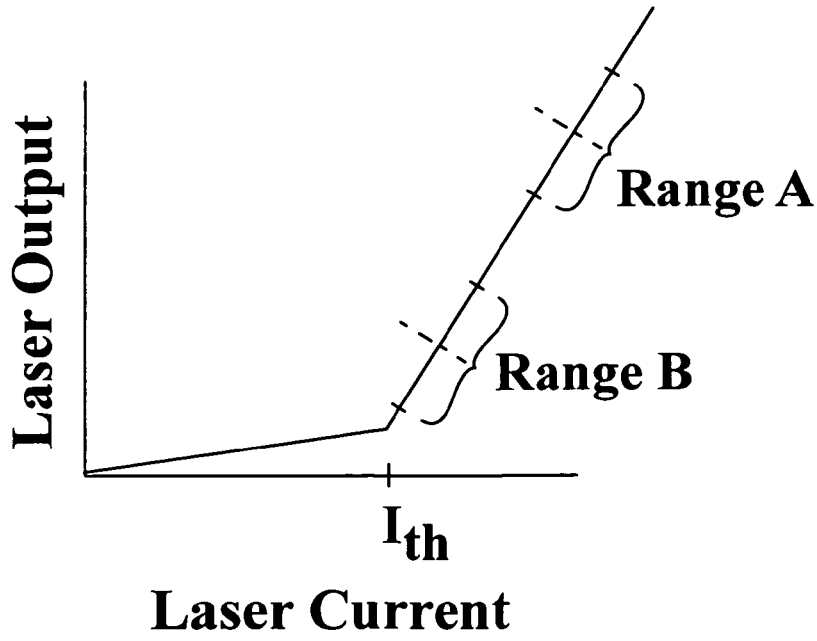
FIG. 4 is a plot of laser current along an axis of abscissa versus optical power along the axis of ordinate.

With reference to FIG. 4, a plot illustrates laser current along the axis of abscissa versus optical power along the axis of ordinate. A minimum current, referred to herein as the threshold current Ith, must be applied to a given laser diode to ensure that the laser diode is emitting laser light. When the current being supplied to the laser diode is less than the threshold current Ith, such as when I_laser=Ibias+Iboost=Idiodebias, atoms in the laser diode's cavity may be excited so as to cause light to be emitted similar to that produced by light emitting diodes (LEDs). However, the current supplied to the laser diode must reach a level greater than or equal to the threshold current Ith in order for the laser diode to enter a lasing mode of operation and thus emit laser light.

As one example, laser driver circuit 102 may be configured, e.g., by setting the drive current source 126 and drive current circuitry 128, including the drive current setting resistor 142, such that the value of the laser power control signal 120 adjusts the laser diode power output between approximately 37 μW at 0.4V (20% duty cycle) and approximately 185 μW at 2V (100% duty cycle), corresponding to the range of laser output power required for anticipated imaging operations. Thus, in this example, the laser diode 102 cannot be adjusted by the laser driver circuit 102 for power levels below 37 uW as suggested by the exemplary data of Table 1. This corresponds to an adjustment range on a plot of laser current along an axis of abscissa versus optical power along the axis of ordinate corresponding to Range A.

TABLE 1

| VR (volts) | LPOW duty cycle (%) | Laser Power Output (uW) |
|---|---|---|
| 0.4 | 20 | 37 |
| 2.0 | 100 | 185 |

However, the range of laser power required for imaging operations may be insufficient to accommodate adjustments to the laser power over a range that is necessary to discharge a corresponding photoconductive surface, e.g., during a run-out process. For example, depending upon the current print speed, the laser output power required for a given run out process may vary from approximately 27.75 μW at 20 pages per minute, down to approximately 9.25 μW at 6 pages per minute as is illustrated in Range B in the exemplary plot of FIG. 4. As such, the laser diode 108 cannot normally be operated for both run-out operations and writing of image data as Range A does not encompass Range B.

Shifting the Operating Range of Laser Output Power

According to one aspect of the present invention, the dynamic laser power output range can be adjusted, e.g., between a range suitable for normal imaging operations and a range suitable for discharging the corresponding photoconductors, during a run out process, using the bias control signal 122. During a run out, such as when powering down the imaging components of the apparatus 10, an automatic power control (APC) operation is modified so as to adjust the laser diode output power to a level suitable for discharging its associated photoconductive surface.

The laser power of the laser diode 108 is calibrated during an APC operation or some other suitable laser power adjustment cycle to operate within a first range of power levels, e.g., by controlling at least one control parameter of the system. For example, the controller 12 may set a control parameter to adjust the laser bias, e.g., via a control signal such as the boost signal 122 shown in FIG. 3 when the calibration control signal 118 is also active. However, control parameters may be values stored, computed or otherwise determined by the controller 12, e.g., values associated with one or more of the signals communicated over the various control and data lines 114, 116, 118, 120 and 122. Control parameters may also correspond to states, logic values, information or other characteristics of the controller 12, the laser driver circuitry 102 or other aspect of the system that can affect the laser power of the corresponding laser source.

In response to receiving the boost signal 122, the laser driver circuit 102 sets the bias current applied to the laser diode 108 to a first state, corresponding to a first bias current level. The controller 12 then modifies the control parameter after the laser driver circuit 102 calibrates the laser power so that the laser source is operable within a second range of power levels that is different from the first range of power levels. For example, controller 12 may adjust the laser control parameter, e.g., bias level via the boost signal 122 after the calibration control signal has been set inactive. In response to the adjusted level of the boost signal 122, the laser driver circuit 102 sets the bias current applied to the laser diode 108 to a second state corresponding to a second bias current level.

The laser beam is operated during a corresponding scanning operation, e.g., during a run out process, at the second bias level such that the operating range of the laser diode is shifted to a level suitable for discharging its photoconductor. For discharge operations, the first bias current level is greater than the second bias current level. That is, the bias control signal 122 is utilized to recalibrate the operating range of the total current applied to the laser diode 108 so as to lower the output power of the laser diode 108 delivered to a corresponding photoconductor by its associated laser beam from Range A, which is suitable for normal imaging operations, to Range B, which is suitable for discharging operations. However, the first and second bias current levels can be set to any level appropriate to achieve the desired shift in dynamic range of laser power of the laser beam.

Figure 5:
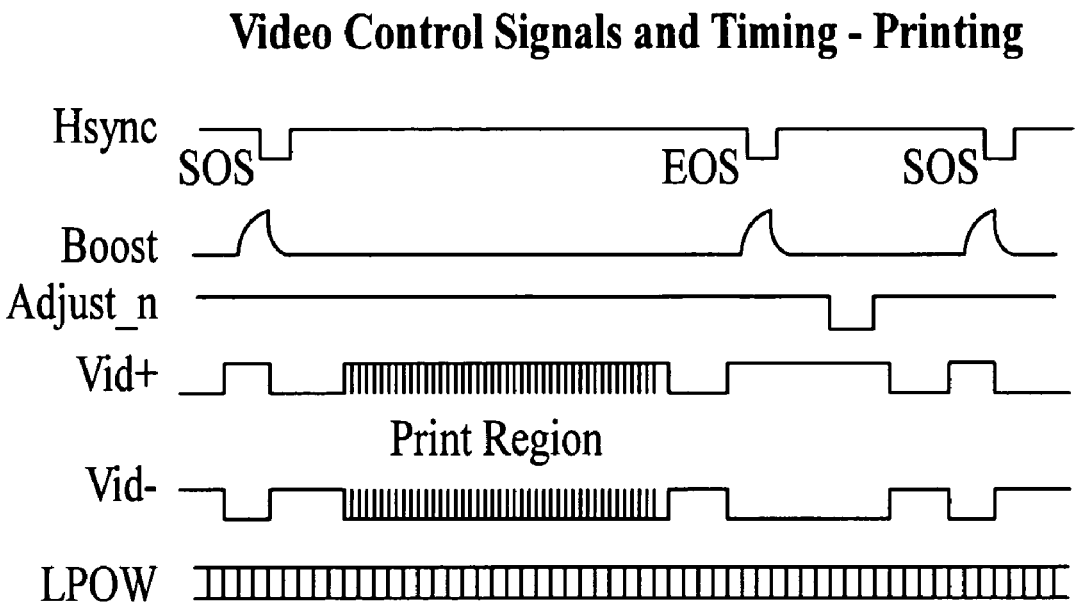
FIG. 5 is a timing diagram for a normal imaging operation.

With reference to FIG. 5, exemplary control signal timing is illustrated for a typical scan of image data written by the printhead 14. In an initial part of a given sweep, a horizontal synchronization signal (Hsync) signal may be generated by detecting that a laser beam has crossed a beam detector and indicates that the laser beam is about to sweep across the print area of a corresponding photoconductive surface. For example, when the first light beam 16K reaches a start of scan location along its scan path, e.g., at the beginning of a sweep for a given facet 46A of rotation, the first beam 16K is picked off, e.g., using a pickoff mirror, and strikes a first sensor (not shown). The timing of this event is referred to hereinafter as Start of Scan (SOS) and designates a horizontal synchronization (Hsync) signal that corresponds with a start of a scanning operation for each of the first and second light beams 16K, 16Y. A pick off may also occur generally towards the end of a sweep for a given facet of rotation. The timing of this event is referred to hereinafter as End of Scan (EOS) and designates an end of a scanning operation for each of the first and second light beams 16K, 16Y.

Similarly, when the third light beam 16C reaches a start of scan location along its scan path, e.g., at the beginning of a sweep for a given facet 46A of rotation, the third beam 16C is picked off, e.g., using a pickoff mirror, and strikes a second sensor (not shown). The timing of this event is also referred to hereinafter as SOS and designates a start of a scanning operation for each of the third and fourth light beams 16C, 16M. A pick off also occurs generally towards the end of a sweep for a given facet of rotation. The timing of this event is referred to hereinafter as EOS and designates an end of a scanning operation for each of the third and fourth light beams 16C, 16M.

As noted above, the scan line includes a non-imaging section wherein the laser beam is outside of an image area of its corresponding photoconductive surface, and a imaging section wherein the laser beam is within the image area of its photoconductive surface. During the SOS and EOS detection, the laser beam is in the non-imaging section of the scan, outside the image area of its photoconductive surface. The SOS/EOS can be detected in any number of ways, e.g., two sensors may be used including a first sensor for SOS and a separate sensor for EOS. Additionally, each light beam may process its own SOS and EOS signals. Still further, the SOS and EOS sensor(s) may be located in any suitable locations, including areas associated with the printhead or areas outside of the printhead, e.g., adjacent to a corresponding photoconductive surface, etc.

It may be desirable to adjust the output of the laser diode 108 to a consistent output power each time the corresponding laser beam crossing the SOS/EOS beam detector so that the Hsync signal is consistently generated, e.g., to maintain a consistent margin positioning when writing scan lines of image data. However, the laser power control signal 120 is variable, e.g., based upon factors such as the current operating mode and color calibration settings. To maintain a consistent laser power output during start of scan and end of scan detection, the bias control signal 122 is applied by the controller to cause the boost current source to modify the amount of current applied to the laser diode 108.

The amount of additional current provided by the boost current source 145 is selected to adjust the laser power output to a consistent value during SOS/EOS detection. That is, the boost current source 145 is adjusted to make up for the difference between the output power level desired for normal imaging operations and the desired output power level for SOS/EOS detection. Thus, as the output power of the laser diode 108 is varied, e.g., based upon current operating mode and color calibration settings, the system will still strike the SOS/EOS detectors with a constant output power level. As such, in the timing diagram, the BOOST signal, such as applied by the bias control signal 122, is illustrated as applying a non-zero boost to corresponding with the active edge of the SOS/EOS signal.

The Vid+ and Vid− signals comprise a low voltage differential signal (LVDS), e.g., a laser modulation signal such as the image data pair 114 that contains the image data used to modulate the laser beam as it is swept across a corresponding photoconductive surface. The Vid+ and Vid− signals may be generated for example, by a application specific integrated circuit (ASIC) in the controller 12 based upon the bitmap image data for a corresponding one of the CYMK color image planes. The Vid+ and Vid− signals are modulated according to associated bitmap image data while the laser beam is swept across the imaging section of the scan line corresponding to the image area of its associated photoconductive surface as represented in the Figure by the designation "Print Region".

The laser output power is controlled by the laser power control signal 120 as described in greater detail above. The Adjust_n signal designates the period for an APC operation, such as when the calibration control signal 118 is active. As illustrated, the APC operation occurs while the laser beam is outside the image area of the photoconductive surface, e.g., while the laser beam is in the non-imaging section of its scan path.

Using a Boost Signal During an APC Operation to Shift Laser Output Power Range

The laser driver's APC operation may be manipulated to allow the output power of the laser diode 108 to go below a minimum value of a normal operating range of power levels while the beam is directed towards the image area of the photoconductive surface, e.g., to go below 37 μW level in the above example. During an APC operation of a runout process, the boost control logic in the controller 12 is timed to introduce a non-zero bias control signal 122, e.g., the bias control signal 122 is set to a first programmable value, to alter the bias point of the laser diode 108. This has the effect of increasing the laser output power during the laser calibration process. Thus, the feedback control system 112 will sense higher than anticipated power output level of the laser diode 108.

The driver circuit 102 will automatically compensate for the higher laser output level detected by the feedback control system 112 by lowering the laser drive current 126. For example, by comparing the voltage across the calibration resistance 146 to the voltage Vr established by the laser power control signal 120 at the comparator 148, the voltage Vc across the charge storage device 150 is lowered until the laser power output by the laser diode 108 matches the level set by the laser power control signal 120 via the input control voltage Vr. Because the bias control signal 122 increases the current seen by the laser diode 108, the drive current from the drive current source 126 will correspondingly be reduced.

While the beam emitted by the laser diode 108 is swept across the image area of the photoconductor during the run out scan, the boost control logic in the controller 12 is configured to provide a different boost, e.g., a second programmable value such as a zero boost value, compared to the first programmable value of the bias control signal 122 applied during the corresponding APC operation. That is, the bias control signal 122 is turned off or otherwise returned to its default value, which reduces the total bias current of the laser driver circuit 102. The difference in the output power of the laser diode 108 while scanning the image region of the corresponding photoconductive surface and the output power of the laser diode 108 during the APC period of the scan is thus related to the value of the bias control signal 122 that is applied during the APC operation.

Figure 6:
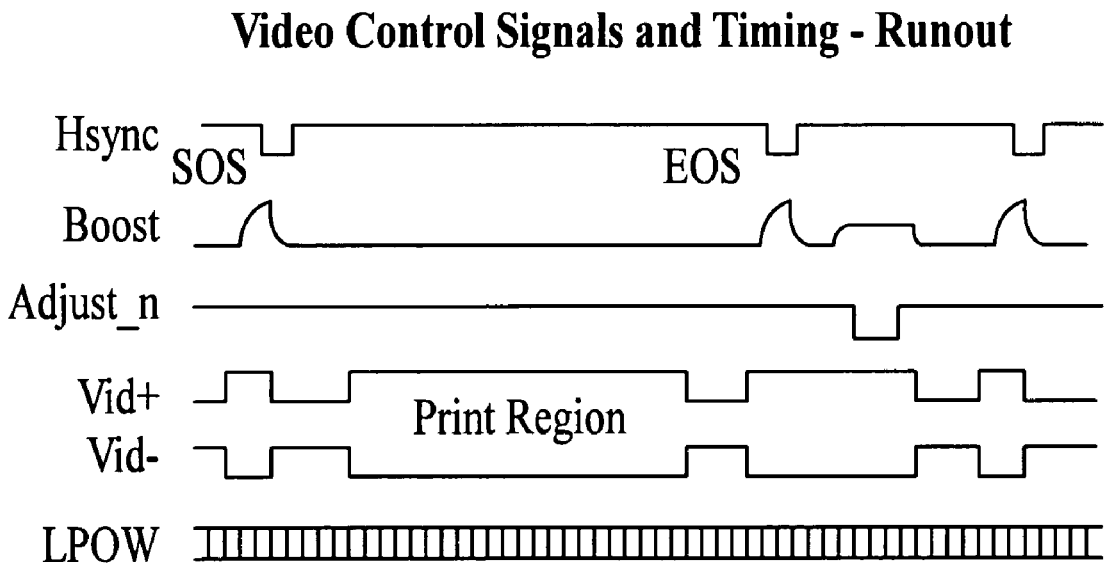
FIG. 6 is a timing diagram for a discharge operation.

FIG. 6, which is reproduced herein, illustrates a steady state cycle of a run out operation according to various aspects of the present invention. The scan line timing of the relevant signals appears similar to that of FIG. 5 with at least two exceptions. In FIG. 6, the laser diode is turned on, i.e., not modulated while the laser beam is within the imaging section of the scan line as illustrated by the vid+ turned on and vid− turned off in the section designated "Print Region" corresponding to the image area of the photoconductive surface. Further, the BOOST signal is modified when the APC is activated, i.e., when the controller 12 sets the Adjust_n control signal active (low in the present example).

Thus, in this example, the controller 12 is configured to set the bias control signal 122 such that the first bias current level during the APC operation is greater than the second bias current level utilized as the beam of the laser diode 108 is swept across the image area of the corresponding photoconductive surface. The above process is repeated for each scan line necessary to discharge or otherwise erase the photoconductive surface.

Accordingly, the operating range of the laser diode is shifted as illustrated in the graph of FIG. 4. For example, the laser diode is calibrated for Range A and is shifted to Range B by modifying the bias current as the beam is swept across the image area of the corresponding photoconductive surface.

Figure 7:
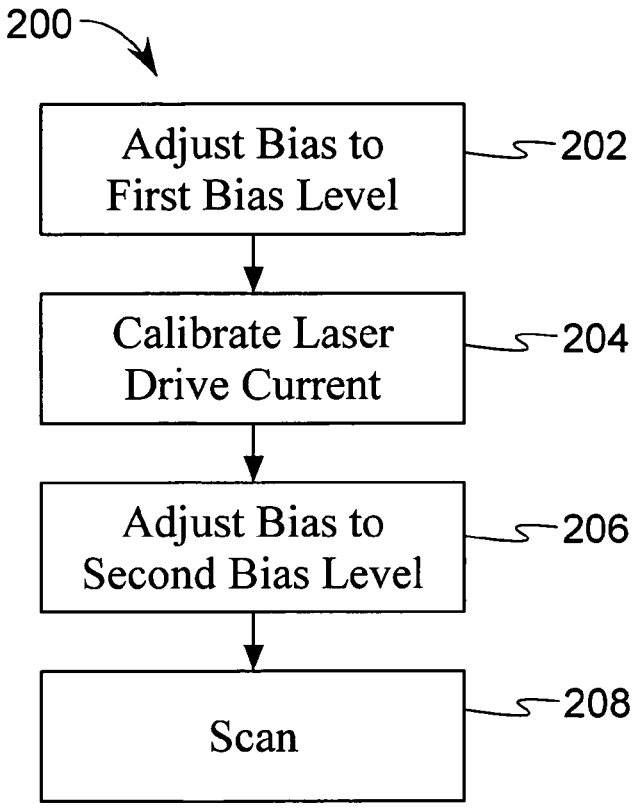
FIG. 7 is a flow chart illustrating a method of shifting the operating range of a laser source.

With reference to FIG. 7, the imaging system of a corresponding electrophotographic device is operated by the method 200 comprising adjusting a bias current applied to a laser source, e.g., the laser diode 108, to a first bias current level at 202. An output power of the laser source is calibrated to a first output power level by adjusting a laser drive current to a first drive current level at 204. The bias current applied to the laser source is then adjusted to a second bias current level at 206 after calibrating the output power of the laser source to the first output power level, such that the output power of the laser source is shifted to a second output power level that is different from the first output power level. A beam emitted by the laser source is then directed towards an image area of a photoconductive surface at the second output power level at 208.

Thus for example, during a run out, such as when powering down the electrophotographic device, the laser scanning system's automatic power control (APC) operation is modified so as to adjust down the laser diode output power to a level suitable for discharging its associated photoconductive surface. Basically, the laser diode is calibrated during an APC operation with a first bias level and is operated during a corresponding scanning operation of a run out process at a second bias level that shifts the operating range of the laser diode to a level suitable for discharging its photoconductor. The image area of the photoconductive surface is thus erased/discharged to a generally uniform level as the beam emitted by the laser source is swept across the imaging section of the scan line.

Boost Signal Calibration

With reference back to FIG. 3, to determine the appropriate bias control signal 122 required to recalibrate the operating range of the laser diode 108, a relationship between a change in the laser power control signal 120 and a corresponding change in the bias control signal 122 may be determined so that a change in the bias control signal 122 has a predictable result on the change in the output power of the laser diode 108. The manner in which the relationship is determined may vary depending upon a number of factors including how the laser power control signal 120 and the bias control signal 122 are generated, how the laser power control signal 120 is converted to the input control voltage Vr, and how the bias control signal 122 is converted into a boost current. Moreover, the relationship may be empirically derived, analytically derived, estimated, or determined in other reasonable manners.

The bias control signal 122 may be generated by the controller 12 as a pulse width modulated boost signal. The controller 12 may thus be operable to set the pulse width modulation bias control signal 122 to a first duty cycle to adjust the laser driver circuit 102 to a first bias current level during an APC operation and to set the pulse width modulation bias control signal 122 to a second duty cycle different from the first duty cycle to adjust the laser driver circuit 102 to a second bias current level when the beam is swept across the image area of the corresponding photoconductive surface when it is desirable to shift the dynamic range of the laser power of the corresponding laser diode 108.

Thus, in the illustrated example, the laser power control signal 120 and the bias control signal 122 each comprise PWM signals. One way to characterize their relationship is to determine a necessary change in duty cycle of the bias control signal 122 to a corresponding change in duty cycle of the laser power control signal 120, or vice versa. In determining this relationship, it is to be expected that the resolution of the laser power control signal 120 may be different from the resolution of the bias control signal 122. For example, the duty cycle of the laser power control signal 120 may be derived from an eight-bit word and the duty cycle of the bias control signal 122 may be derived from a five-bit word. As such, appropriate compensation may be required. Further, adjustments may be limited based upon the resolution of the laser power control signal 120 and/or the resolution of the bias control signal 122.

Figure 8:
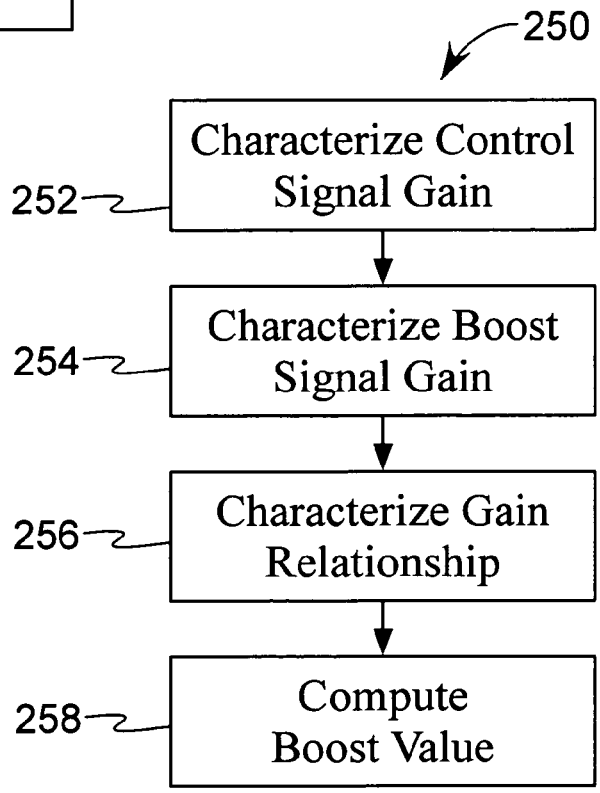
FIG. 8 is a flow chart illustrating a method of calibrating a system to shift the operating range of a laser source.

With reference to FIGS. 3 and 8, one exemplary method 250 to calibrate the bias control signal 122 to perform discharge operations is illustrated. The method 250 may utilize the conditioning and feedback circuitry 152 to characterize the performance of the laser driver 102 under various conditions to characterize a change in duty cycle of the boost signal 122 to a corresponding change in duty cycle of the laser power control signal 120.

At 252, the gain of a first control signal is characterized. For example, the laser power gain may be characterized as a change in duty cycle of the laser power control signal 120 relative to a change in the output power of the laser diode 108. The laser image data, e.g., the image data pair 114, may be configured so as to turn the laser diode 1080N, and the laser power control signal 120 may be set to a low PWM value, designated Lpow_PWM_Low, e.g., 50% duty cycle. After the system stabilizes, the voltage across the calibration resistance 146 is measured using the conditioning and feedback circuitry 152, the result of which is designated herein as VmL50. Next, the Lpow PWM duty cycle is increased to a relatively high PWM value, designated Lpow_Pwm_High, e.g., 75% duty cycle. Again, the voltage across the calibration resistance 146 is measured using the conditioning and feedback circuitry 152, the result of which is designated herein as VmL75. The above parameters characterize a change in laser power as a function of a change in the duty cycle of the laser power control signal 120.

At 254, a boost signal gain is characterized as a change in duty cycle of the boost signal relative to a change in the output power of the laser source. For example, the bias control signal 122 may be applied to directly alter the bias current outside the closed loop compensation provided by the driver circuitry 102. Under this arrangement, the bias control signal 122 is set to a low value, e.g., OFF, and a voltage measurement is taken at a predetermined laser power control signal duty cycle value, e.g., 50% duty cycle. The voltage across the calibration resistance 146 is sampled by the conditioning and feedback circuitry 152, and the result is designated VmB0. With the same laser power control signal duty cycle, the bias control signal 122 is increased, e.g., to a boost with duty cycle of 20%, which is designated Boost_PWM. The voltage across the calibration resistance 146 is sampled by the conditioning and feedback circuitry 152, and the result is designated VmB20. The above parameters characterize a change in output power of the laser diode 108 as a function of change in the duty cycle of the bias control signal 122.

Using the above parameters, the system laser power gain can be computed as:

$$Glpow=(VmL75-VmL50)/(LPow_PWM_High-Lpow_PWM_Low)$$

Using the above parameters, the system boost gain can be computed as:

$$Gboost=(VmB20-VmB0)/Boost_PWM$$

At 256, a gain relationship is characterized as the laser power gain relative to the boost gain. For example, knowing the relationships for Glpow and Gboost, allows the controller 12 to correspond an amount of bias control signal 122 to be applied during an APC operation to achieve a desired laser output power reduction, e.g., to shift from Range A to Range B in the graph of FIG. 4. That is, the relationship of laser power boost to laser power gain may be defined by the expression:

$$GltoB = Glpow/Gboost$$

At 258, a desired boost duty cycle may be computed by multiplying the gain relationship by a difference between the first output power level and the second output power level. For example, dividing Glpow by Gboost describes a scaling factor GltoB that relates a change in the PWM duty cycle of the laser power control signal 120 to an equivalent change in the PWM duty cycle of the bias control signal 122. Also, the relationship between boost pulse width modulation and laser power control signal pulse width modulation can be described by the equation:

$$BoostPWM = dLPOW * GltoB$$

Where dLPOW is the effective change in the laser power control signal 120 desired when manipulating the bias control signal 122. The above relationship between the boost signal and the laser power control signal 120 can be used in conjunction with the value of the laser power control signal 120 when the printhead 14 is operating during run out.

$$dLPOW = LPOW - DesiredLPOWDuringRunout$$

For example, referring to table 2, assume that the print speed is 10 pages per minute, as designated in Row 2. At 10 pages per minute, assume that the required laser power output is 12.95 uW for a run out process. Also assume that laser power output signal is operated at a 27% duty cycle. To achieve a laser power of 12.95 uW, the laser power control signal 120 would require a duty cycle of 7%. However, as noted above, due to limitations of the laser driver circuitry 102, the duty cycle of the laser power control signal 120 cannot be adjusted below 20%. Thus, applying the formulas herein:

$$dLPOW = LPOW - DesiredLPOWDuringRunout$$

$$dLPOW = 27\% - 7\%$$

$$dLPOW = 20\%$$

$$BoostPWM = dLPOW * GltoB$$

$$BoostPWM = 20 * Glpow/Gboost$$

Thus, by applying a bias control signal 122 corresponding to a value of 20*Glpow/Gboost during the APC calibration, and then by turning off the bias control signal 122 when scanning the printable region of the corresponding photoconductive surface, the effective result is that the photoconductive surface is scanned with a beam output of approximately 12.95 uW, e.g., within reasonable tolerances resulting from the resolution of the laser power control signal 120, the bias control signal 122 and other components of the laser driver 102.

TABLE 2

| | Exemplary laser power control signal values and corresponding laser output | | |
|---|---|---|---|
| Print Speed (ppm) | LPOW (%) | LPOW Equivalent During Run out (%) | Laser Power Output (uW) |
| 20 | 27 | 15 | 27.75 |
| 10 | 27 | 7 | 12.95 |
| 6 | 27 | 5 | 9.25 |

Other methods may be used in addition to, or in lieu of using the bias control signal 122 to alter the operating range of output power of the laser diode 108. For example, other techniques may be utilized to introduce an additional current or to provide a first current level to the laser diode 108 during a calibration process, e.g., an APC operation, and to operate the laser diode 108 while scanning an image area of a photoconductive surface at a second current.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. For example, the various aspects of the present invention may be implemented in a copier, facsimile machine, multi-function machine, or other suitable structure.

Having thus described the invention of the present application in detail and by reference to preferred embodiments thereof, it will be apparent that modifications and variations are possible without departing from the scope of the invention defined in the appended claims.

What is claimed is:

1. A method of adjusting the dynamic range of laser power in an electrophotographic device comprising:

calibrating a laser power of a laser source during a laser power adjustment cycle of operation such that a beam output by said laser source has a power level within a first dynamic range of power levels, wherein:

the power level of said beam is adjustable within said first dynamic range of power levels by controlling a value of a laser power control signal; and a limited control range of values of said laser power control signal correspondingly limits the operating range of said beam to said first dynamic range of power levels;

modifying at least one laser control parameter other than said laser power control signal after calibrating said laser power of said laser source so as to shift the operating range of said laser source from said first dynamic range to a second dynamic range that is different from said first dynamic range, wherein said limited control range of values of said laser power control signal correspondingly limits the operating range of said beam to said second dynamic range of power levels; and controlling the power level of said beam emitted by said laser source within said second dynamic range of power levels by setting said laser power control signal to a predetermined value when said beam is directed towards an image area of a photoconductive surface.

2. The method according to claim 1, further comprising:

erasing said photoconductive surface by sweeping a beam emitted by said laser source across said image area of said photoconductive surface; and operating said laser source within said second range of power levels so as to discharge said image area to a generally uniform level.

3. The method according to claim 1, wherein said at least one laser control parameter comprises a bias signal for affecting a bias current applied to said laser source, said method further comprising:

setting said bias current to a first bias current level in response to said bias signal while calibrating said laser power; and setting said bias current to a second bias current level which is less than said first bias current level in response to a modification to said bias signal, at least while a beam emitted by said laser source is directed towards said image area of said photoconductive surface.

4. The method according to claim 1, wherein said at least one laser control parameter comprises a bias signal for affecting a bias current applied to said laser source and a calibration control signal for designating said laser power adjustment cycle, said method further comprising:

adjusting said bias signal to a first state for calibrating said laser power while said calibration control signal is also active; and adjusting said bias signal to a second state which is different from said first state for directing said laser source towards said image area of said photoconductive surface when said calibration control signal is inactive.

5. The method according to claim 4, wherein said bias signal comprises a programmable boost signal that modifies a bias current applied to said laser source, said programmable boost signal having a first programmable value corresponding to said first state and a second programmable value corresponding to said second state.

6. The method according to claim 5, wherein said programmable boost signal comprises a pulse width modulated signal, and said first programmable value comprises setting said boost signal to a first pulse width modulation duty cycle and said second programmable value comprises setting said boost signal to a second pulse width modulation duty cycle.

7. The method according to claim 1, wherein:

said output power of said laser source is calibrated to said first range of power levels comprising:

comparing a first signal corresponding to a measured output power of said laser source to an input control signal set to a predetermined laser power control value; and adjusting a laser drive current applied to said laser source to cause said laser source to emit a laser beam so that said measured output power corresponds to said predetermined laser power control value of said laser power control signal.

8. The method according to claim 1, further comprising:

providing a pulse width modulated laser power control signal for varying said laser power;

wherein:

said at least one laser control parameter comprises a programmable pulse width modulated boost signal for affecting a bias current applied to said laser source, a first duty cycle of said pulse width modulated boost signal affects operation of said laser power control signal within a first range of laser power;

a second duty cycle of said pulse width modulated boost signal affects operation of said laser power control signal within a second range of laser power which is different from said first range; and modifying at least one laser control parameter after calibrating said laser power comprises modifying said pulse width modulated boost signal from said first duty cycle to said second duty cycle.

9. The method according to claim 8, wherein characterizing said change in duty cycle of said boost signal to said corresponding change in duty cycle of said laser power control signal comprises:

characterizing a laser power gain as a change in said output power of said laser source relative to a change in duty cycle of said laser power control signal;

characterizing a boost signal gain as a change in said output power of said laser source relative to a change in duty cycle of said boost signal;

characterizing a gain relationship as said laser power gain relative to said boost gain; and computing a desired boost duty cycle by multiplying said gain relationship by a difference between a first desired power level within said first range of power levels and a second desired power level within said second range of power levels.

10. An imaging system for an electrophotographic device comprising:

a laser source for emitting a laser beam;

a scanner for causing said laser beam to sweep along a scan line;

a laser driver circuit for supplying at least a bias current and a laser drive current to cause said laser source to emit said beam;

a controller communicably coupled to said laser driver for controlling an output power of said laser beam;

a laser power control signal coupled between said laser driver circuit and said controller; and a second control signal other than said laser power control signal for affecting at least one of said bias current and said laser drive current, wherein:

said second control signal is set to a first value by said controller during a laser power adjustment cycle of operation such that a beam output by said laser source has a power level within a first dynamic range of power levels, the power level of said beam is adjustable within said first dynamic range of power levels by controlling a value of said laser power control signal and a limited control range of values of said laser power control signal correspondingly limits the operating range of said beam to said first dynamic range of power levels; and said second control signal is set to a second value by said controller after calibrating said laser power so as to shift the operating range of said laser source from said first dynamic range to a second dynamic range that is different from said first dynamic range, such that said limited control range of values of said laser power control signal correspondingly limits the operating range of said beam to said second dynamic range of power levels and said laser source is operable within a second range of power levels by setting said laser power control signal to a predetermined value when said laser source is swept along an image area of a photoconductive surface.

11. The imaging system according to claim 10, wherein:

said scan line has a non-imaging section wherein said beam is outside of said image area of said photoconductive surface and a imaging section wherein said beam is within said image area of said photoconductive surface;

said second control signal comprises a bias control signal for adjusting said bias current supplied to said laser source by said laser driver circuit to a first bias current level;

said controller causes said laser driver to calibrate said output power of said laser beam to a first output power level within said first range of power levels during a calibration control operation based at least upon said first bias current level while said laser beam is in said non-imaging section of said scan line; and said controller sets said bias control signal to a second bias current level that is different from said first bias current level such that said output power of said laser beam is set to a second output power level within said second range of power levels while said beam is within said imaging section of said scan line.

12. The imaging system according to claim 11, wherein said bias control signal is generated by said controller as a pulse width modulated boost signal, said controller operable to adjust said pulse width modulation boost signal to a first duty cycle to adjust said laser driver circuit to said first bias current level; and to adjust said pulse width modulation boost signal to a second duty cycle different from said first duty cycle to adjust said laser driver circuit to said second bias current level.

13. The imaging system according to claim 12, wherein said laser driver circuit further comprises:

bias circuitry for establishing a first fixed bias current applied to said laser source; and a boost current source coupled to said bias circuitry so as to modify said fixed bias current by a programmable amount based upon said duty cycle of said bias control signal.

14. The imaging system according to claim 11, further comprising:

a calibration control signal coupled between said controller and said driver circuit for designating said calibration control operation, wherein:

said controller is configured to initiate said calibration control operation via said calibration control signal when said laser source is within said non-imaging section of said scan line.

15. The imaging system according to claim 11, wherein said controller deactivates said calibration control signal and subsequently sets said bias control signal for adjusting said bias current supplied to said laser source by said laser driver circuit to said second bias current level before said beam enters said imaging section of said scan line.

16. The imaging system according to claim 11, wherein said controller is configured to set said bias control signal such that said first bias current level is greater than said second bias current level.

17. A method of adjusting a dynamic range of laser power in an imaging system for an electrophotographic device comprising:

sweeping a beam emitted by a laser source along a scan line, said scan line having a non-imaging section wherein said beam is outside of an image area of a photoconductive surface and a imaging section wherein said beam is within said image area of said photoconductive surface;

setting a bias current supplied to said laser source to a first bias current level;

calibrating a laser drive current while said beam is within said non-imaging section of said scan line to a level necessary to cause said beam to be emitted by said laser source at a first output power level, said laser drive current based at least upon said first bias current level, wherein:

the power level of said beam is adjustable within a first dynamic range of power levels by controlling a value of a laser power control signal; and a limited control range of values of said laser power control signal correspondingly limits the operating range of said beam to said first dynamic range of power levels;

setting said bias current supplied to said laser source to a second bias current level that is different from said first bias current level after calibrating said laser drive current so as to shift the operating range of said laser source from said first dynamic range to a second dynamic range that is different from said first dynamic range, wherein said limited control range of values of said laser power control signal correspondingly limits the operating range of said beam to said second dynamic range of power levels; and controlling said beam at within said second dynamic range when said beam is directed towards said image area of said photoconductive surface.

18. The method according to claim 17, further comprising:

providing a laser power control signal that designates said first output power of said laser source; wherein calibrating said laser drive current further comprises:

setting said laser power control signal to a predetermined value;

calibrating said first output level of said laser source to said predetermined value; and maintaining said laser power control signal at said predetermined value while said beam is within said imaging section of said scan line.

19. The method according to claim 18, wherein said second bias current level is determined by a controller comprising:

determining a change in said laser power control signal necessary to adjust said second output power level of said laser source;

characterizing a bias adjustment as a change in said laser power control signal relative to a corresponding change in said bias current signal; and setting said second bias current level based upon said first bias current level and said bias adjustment.

20. The method according to claim 17, further comprising:

characterizing a bias gain as a change in said output power of said laser source relative to a change in said bias current;

characterizing a drive current gain as a change in said output power of said laser source relative to a change in said drive current;

characterizing a scaling factor by corresponding said drive current gain to said bias gain; and computing a value for said bias signal corresponding to said first bias level by multiplying said scaling factor by a desired change in said laser power control signal.

* * * * *